US011006220B2

(12) United States Patent
Babb et al.

(10) Patent No.: US 11,006,220 B2
(45) Date of Patent: May 11, 2021

(54) LOUDSPEAKER WITH MULTIPLE STAGE SUSPENSION SYSTEM

(71) Applicant: Robert Bosch GmbH, Stuttgart (DE)

(72) Inventors: Alan J. Babb, Burnsville, MN (US); Andrew M. Grunloh, Columbia Heights, MN (US); David E. Carlson, Savage, MN (US)

(73) Assignee: Robert Bosch GmbH, Stuttgart (DE)

( * ) Notice: Subject to any disclaimer, the term of this patent is extended or adjusted under 35 U.S.C. 154(b) by 92 days.

(21) Appl. No.: 16/336,736

(22) PCT Filed: Feb. 3, 2017

(86) PCT No.: PCT/US2017/016567
§ 371 (c)(1),
(2) Date: Mar. 26, 2019

(87) PCT Pub. No.: WO2018/093406
PCT Pub. Date: May 24, 2018

(65) Prior Publication Data

US 2020/0053471 A1 Feb. 13, 2020

Related U.S. Application Data

(60) Provisional application No. 62/424,873, filed on Nov. 21, 2016.

(51) Int. Cl.
*H04R 9/04* (2006.01)
*H04R 7/12* (2006.01)
(Continued)

(52) U.S. Cl.
CPC ..... *H04R 9/045* (2013.01); *H04R 7/127* (2013.01); *H04R 7/18* (2013.01); *H04R 9/025* (2013.01); *H04R 9/06* (2013.01); *H04R 2400/11* (2013.01)

(58) Field of Classification Search
CPC ..... H04R 9/045; H04R 9/06; H04R 9/025; H04R 7/127; H04R 7/18
See application file for complete search history.

(56) References Cited

U.S. PATENT DOCUMENTS 1,715,057 A 5/1929 Decaux
3,496,307 A 2/1970 Sotome
(Continued)

FOREIGN PATENT DOCUMENTS

CN 101300896 A 11/2008
CN 203722816 U 7/2014
(Continued)

OTHER PUBLICATIONS

International Search Report and the Written Opinion of the International Searching Authority, dated Jun. 14, 2017; Intl. Appl. No. PCT/US2017/016567.
(Continued)

*Primary Examiner* — Sunita Joshi
(74) *Attorney, Agent, or Firm* — Michael Best & Friedrich LLP

(57) ABSTRACT

A multi-stage mechanical suspension system extends a linear operating range for a loudspeaker and prevents mechanical damage on explosive peaks. The system includes a pair of spaced contact receivers that limit the travel of a contactor. The system provides a flat linear response at low frequencies as the contact receivers are intermittently or occasionally contacted by the contactor during operation of the loudspeaker. The system enables creation of different regions of non-linearity within a total stiffness versus deflection curve of a loudspeaker suspension system. The non-linearity in each region can be controlled individually, so long as the non-linearity by region increases moving away from the rest position. Thus, a plateau of substantially linear stiffness may extend for a large portion of the total displace-
(Continued)

ment allowed for a voice coil and suspension components before a region of non-linear stiffness occurs only at the ends of an allowable excursion to limit the motion. More than two regions of stiffness also can be created to achieve maximum performance and stability.

20 Claims, 9 Drawing Sheets

(51) Int. Cl.

| | |
|---|---|
| ***H04R 7/18*** | (2006.01) |
| ***H04R 9/02*** | (2006.01) |
| ***H04R 9/06*** | (2006.01) |

(56) References Cited

U.S. PATENT DOCUMENTS

| | | | | |
|---|---|---|---|---|
| 4,297,537 | A | 10/1981 | Babb | |
| 4,965,839 | A * | 10/1990 | Elieli | H04R 1/24 381/184 |
| 5,471,437 | A | 11/1995 | Schutter et al. | |
| 6,639,993 | B2 | 10/2003 | Kemmerer et al. | |
| 9,014,412 | B2 | 4/2015 | Humphreys et al. | |
| 2005/0111689 | A1 | 5/2005 | True | |
| 2005/0147272 | A1 | 7/2005 | Hyre et al. | |
| 2013/0121522 | A1 * | 5/2013 | Flavignard | H04R 1/30 381/340 |
| 2014/0241536 | A1 | 8/2014 | Adams et al. | |
| 2015/0201294 | A1 | 7/2015 | Risberg et al. | |

FOREIGN PATENT DOCUMENTS

| | | | |
|---|---|---|---|
| EP | 1047284 | A2 | 10/2000 |
| WO | 200163965 | A2 | 8/2001 |
| WO | 2002093976 | A1 | 11/2002 |

OTHER PUBLICATIONS

International Preliminary Report on Patentability for Application No. PCT/US2017/016567 dated May 31, 2019 (9 pages).

Translation of National Intellectual Property Administration People's Republic of China Search Report for Application No. 201780071694.X dated Jun. 9, 2020 (3 pages).

* cited by examiner

LOUDSPEAKER WITH MULTIPLE STAGE SUSPENSION SYSTEM

RELATED APPLICATIONS

This application claims priority from U.S. provisional application 62/424,873, filed Nov. 21, 2016, the entire content of which is hereby incorporated by reference.

BACKGROUND

The present invention relates to a multi-stage mechanical suspension system for a loudspeaker.

At the present time conventional moving diaphragm electroacoustic transducers have a permanent magnetic circuit that interacts with a coil that is energized by an amplified audio signal. This alternating current (AC) signal creates a current in the coil that generates a force equal to B*l*i (where B=the permanent magnetic field strength, l=the length of wire in the coil immersed in the permanent magnetic field, and i=the current flowing in the coil). The direction of the force is dependent on the polarity of the current. The force (Bli) generates motion in the diaphragm of an electroacoustic transducer which has a mass (Mms). The restoring force is provided by flexible, spring-like connections between the diaphragm and the stationary parts of the loudspeaker (frame, permanent magnetic circuit, etc.) that act as a mechanical suspension system. Typically there are two or more of these flexible connections.

SUMMARY

While designing a new low frequency loudspeaker or electroacoustic transducer that has a requirement of almost 150% the displacement capability of existing designs, the need for a better suspension system was recognized. In developing the criteria for the improved suspension system, the need for a multi-stage stiffness curve was deemed most beneficial. A multi-stage stiffness curve for performance of a suspension is plotted as a restoring force versus displacement. Current state of the art flexible connections (suspension system) that provide the restoral force are always all connected. That limits the ability to shape the stiffness versus deflection curve.

Since stiffness (Kms) is additive, a restoring force is proportional to the sum of all the force versus deflection curves of these flexible connections (see the line B in FIG. 1 and the line D in FIG. 2 that are not flattened). The solid line B is for reference and is a measurement of a typical electroacoustic transducer. The solid line D is for reference and is a measurement of force versus displacement for a typical electroacoustic transducer. These curves must be designed to have a correct stiffness at near zero displacement in order to achieve a correct resonant frequency (Fs) for the transducer design ($Fs=1/2\pi\sqrt{Kms/Mms}$). The restoring force must also be a non-linear function or the diaphragm would move further by applying more power, and eventually the physically available space would be exceeded and thus the moving parts of the transducer would potentially be damaged in an impact with the stationary parts. To prevent this impact from happening, the combined total stiffness curve of all the flexible connections must be designed to be somewhat asymptotic with the slope increasing rapidly at a displacement that is less than what would cause physical damage to the moving parts. In the current state of the art, the suspension undergoes a fairly significant amount of what the industry refers to as "break-in". As the suspension system moves, the suspension becomes less stiff due to minor damage and material wear. This means that the suspension system must protect the electroacoustic transducer from over-excursion in its "broken-in" state and not in a new state. This break-in occurs more at the higher excursions, when the material of the suspension is working hard to limit the motion of the diaphragm.

The starting stiffness is set by the design requirements and the ending stiffness is set by physical limitations, and the area in between those two is only adjustable in small ways because there generally must be a smooth curve connecting the two ends. This is true because most suspensions rely on using only the bending stiffness of a material that is formed into a shape that fits more material length into a space then would occur if the material were in a straight line. This means that unless the loudspeaker is designed to intentionally include areas of stress concentration or hinge points that exceed the material yield strength, there will not be a substantial knee shape in the central portion of the force versus deflection curve.

FIGS. 3-5 show the convolutions that are typical in a surround 20 for the suspension components of a high displacement electroacoustic transducer. If the stress at the apex of any of those convolutions exceeds the yield strength of the material, that area of the suspension acts as a hinge that further concentrates the stress, strain, and the resulting damage to the material into a very small area. FIG. 3 is a cut-away view of the surround 20 at zero displacement corresponding to a rest position. FIG. 4 is a cut-away view of the surround 20 at ½ (50%) of maximum displacement. Thus, FIG. 4 shows the surround 20 deformed to approximately 50% of its total material length. Achieving a very pronounced knee just at the very end of the curve is possible by pulling the material taut as shown in a cutaway view of the surround 20 at maximum displacement (100% material length) in FIG. 5. Pulling the material of the surround 20 taut as shown in FIG. 5 is destructive to the materials currently used in most loudspeaker suspensions. This makes neither of those options a wise design choice.

The non-linearity in an electroacoustic transducer is also a major cause of distortion (the difference between the signal put into the transducer and the output of the electroacoustic transducer). The non-linear stiffness acts as a displacement dependent mechanical compressor. Designing the non-linear stiffness curve to be symmetric about the zero displacement point is very difficult. This asymmetry can cause the midpoint of the voice coil displacement of the speaker to shift when in operation from its natural resting position. This offset leads to system instability, damage, distortions, and can lead to premature failures.

In one embodiment, a loudspeaker having a frame includes a suspension system secured to the frame, a voice coil disposed within the frame and suspended by at least the suspension system, and at least one contactor movable by the voice coil, and a front contact receiver that is not continuously engaged with the contactor or the voice coil, the front contact receiver being configured to limit frontward movement of the contactor and the voice coil. The loudspeaker further includes a rear contact receiver that is not continuously engaged with the contactor or the voice coil, the rear contact receiver being configured to limit rearward movement of the contactor and the voice coil. The contactor is capable of engaging at least one of the front contact receiver and the rear contact receiver to limit displacement of the contactor and the voice coil.

In another embodiment, a method of operating a multiple-stage loudspeaker including a voice coil suspended by a suspension system, at least one contactor movable by the voice coil, and a contact receiver that is not continuously physically engaged with the contactor or the voice coil, comprises applying a first electrical input to the voice coil to vibrate the voice coil and produce sound, wherein when the contactor moves and does not engage the contact receiver, the loudspeaker provides an essentially linear stiffness for a portion of a total displacement of the voice coil. The method further includes applying a second electrical input to the voice coil to vibrate the voice coil and produce sound, wherein when the movable contactor engages the contact receiver, the loudspeaker provides an essentially non-linear stiffness for an increased displacement of the voice coil.

Other aspects of the invention will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 6:
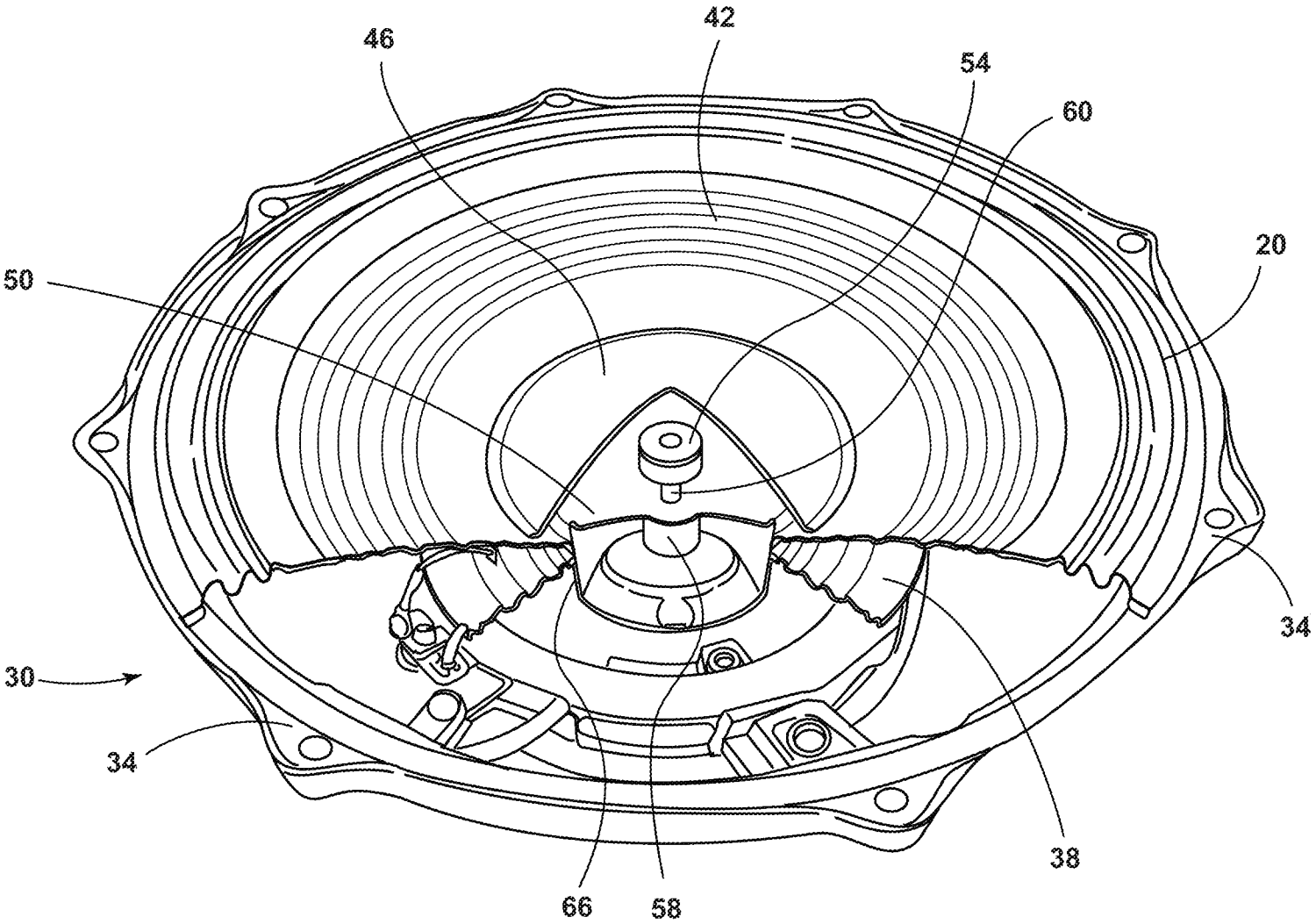
FIG. 6 shows a partial cut-away perspective view of one embodiment of a loudspeaker with a multiple stage suspension system.

FIG. 6 shows a multiple-stage loudspeaker 30 having a frame 34. FIG. 6 shows a cutaway view of a surround 20, a flexible rear spider 38 and a diaphragm 42. In FIG. 6, the diaphragm is secured about an outer periphery to an inner periphery of the surround 20. The surround 20 is secured to the frame 34. FIG. 6 also shows a dust dome 46 that is cut-out to illustrate a contactor 50. Further, FIG. 6 shows a front contact receiver 54 joined to a rear contact receiver 58 by a support post 60. The support post 60 fixedly supports the front contact receiver 54 and the rear contact receiver 58 at opposing ends thereof. Moreover, FIG. 6 shows a cut-out of a generally cylindrical shaped voice coil 66 that is better illustrated in the cross sectional view of the loudspeaker 30 as shown in FIG. 7.

Figure 7:
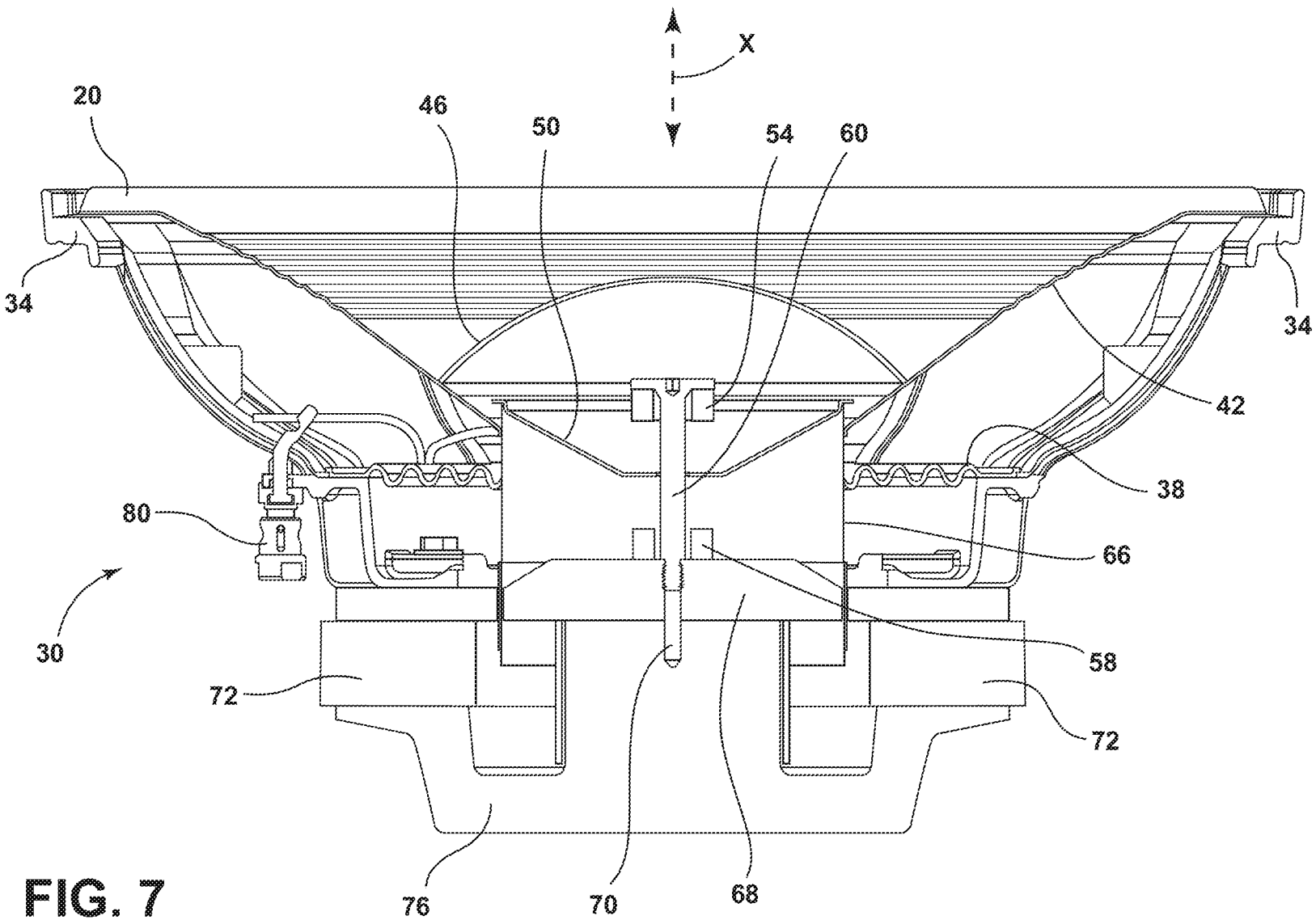
FIG. 7 illustrates a partial cross-section side view of the loudspeaker of FIG. 6.

FIG. 7 shows the spider 38 secured about an inner periphery to the voice coil 66 and about an outer periphery to the frame 34 for suspending the voice coil. Further, FIG. 6 shows the diaphragm 42 secured about in inner periphery to the voice coil 66 and about the outer periphery to the surround 20. The spider 38, the surround 20, and the diaphragm 42 act as suspension components that define a suspension system for the voice coil 66 of the loudspeaker 30. Further, FIG. 6 shows the dust dome 46 secured to the diaphragm 42. The suspension components are joined by adhesives or other methods. The surround 20 and the spider 38 provide a substantially linear stiffness opposing movement of the voice coil 66 for a certain range of movement.

The loudspeaker 30 shown in FIG. 7 includes a pole tip 68 that extends into an interior of the voice coil 66. The support post 60 is secured to the pole tip 68. The pole tip 68 is secured to the center pole 70 in a stationary position. Thus, the support post 60 is rigid and holds or maintains the front contact receiver 54 and the rear contact receiver 58 stationary relative to the surrounding movable voice coil 66. The contactor 50 is secured to a front cylindrical edge of the voice coil 66. The contactor 50 has an aperture dimensioned to receive the support post 60 therethrough, so that the contactor 50 is displaceable axially relative to the support post 60. Thus, the contactor 50 is movable along a single axis X defined by a length of the support post 60 to move forwardly or rearwardly with the voice coil 66, at a generally linear stiffness for a certain range of movement.

A multi-stage mechanical suspension system for the loudspeaker is formed by the suspension system formed by the spider 38, the surround 20, and the diaphragm 42, in combination with the contactor arrangement that includes the contactor 50 and the contact receivers 54, 58.

Figure 8:
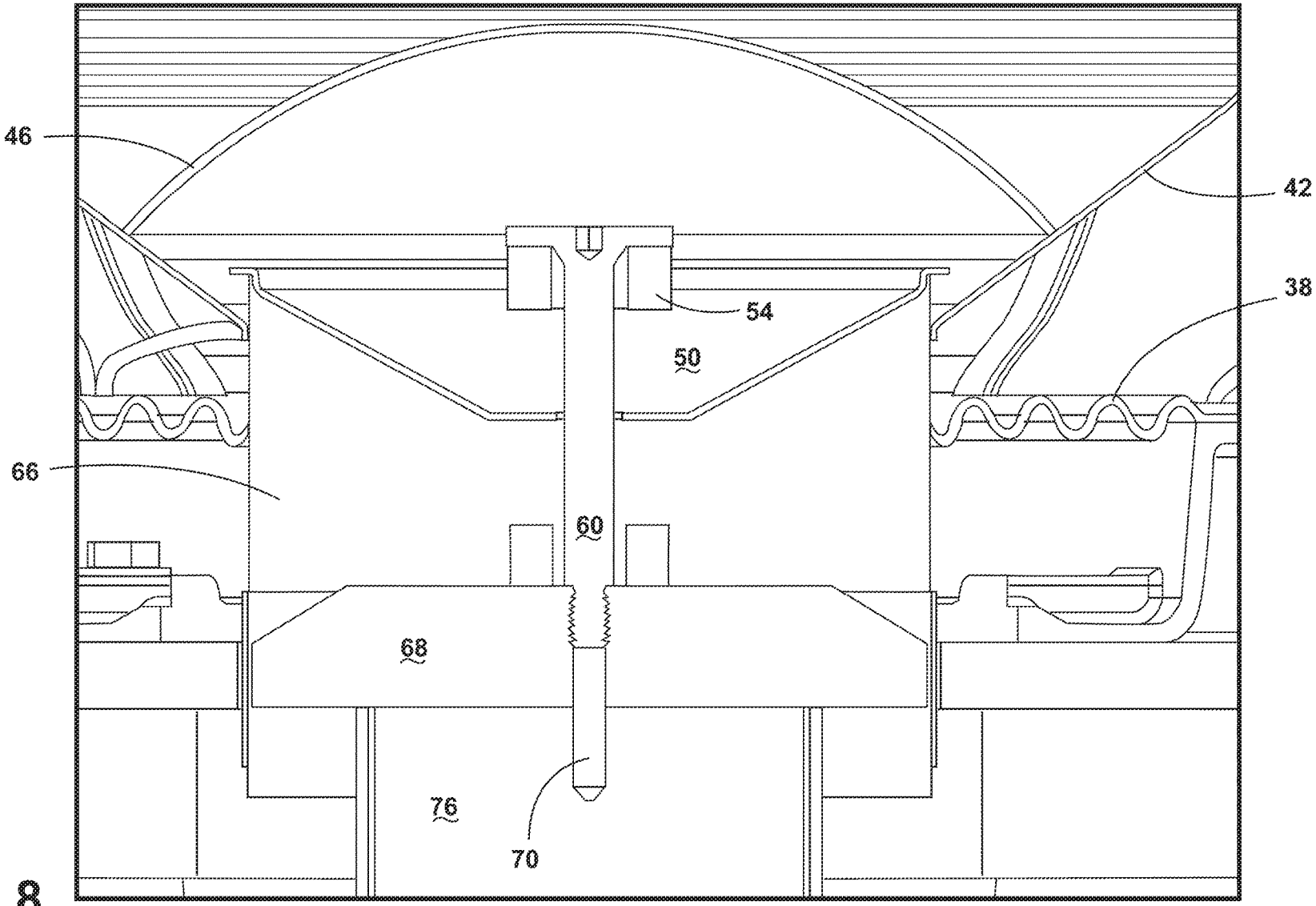
FIG. 8 shows a close up partial cross-section view of the side view of FIG. 7.

FIG. 7 also shows a hollow toroid shaped magnet 72 provided on or within a back plate 76 disposed adjacent the pole tip 68. FIG. 7 shows an electrical contact 80 for receiving power from a power source (not shown) to drive the voice coil 66. FIG. 8 is a close-up partial cut-away view of the voice coil 66 and other elements shown in FIG. 7. The voice coil 66 includes a wound wire (not shown) for receiving current from a power source that generates an electromagnetic field for moving the voice coil 66 relative to the magnet 72 and other components, essentially along the X-axis to generate sound.

Figure 9:
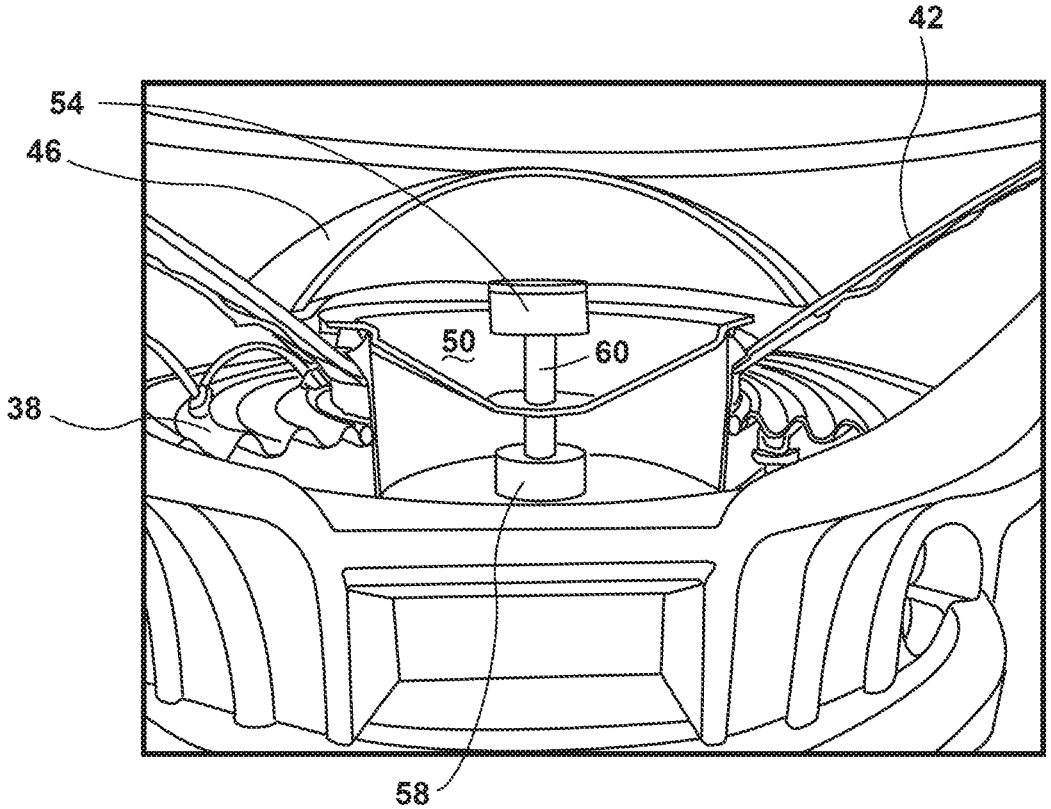
FIG. 9 illustrates a close up partial cut-away view of the loudspeaker of FIG. 6 at a natural rest position for a contactor.
Figure 10:
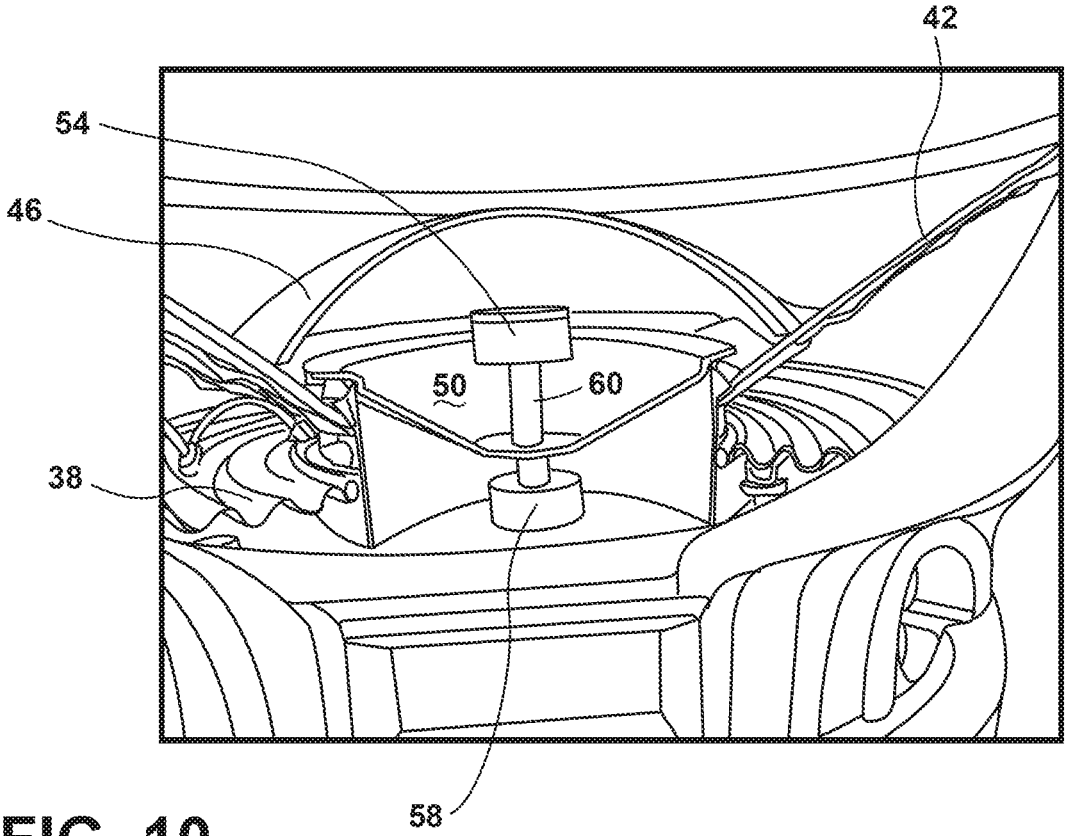
FIG. 10 illustrates a close up partial cut-away view of the loudspeaker of FIG. 6 at a minus five millimeter (mm) displacement position for the contactor.
Figure 11:
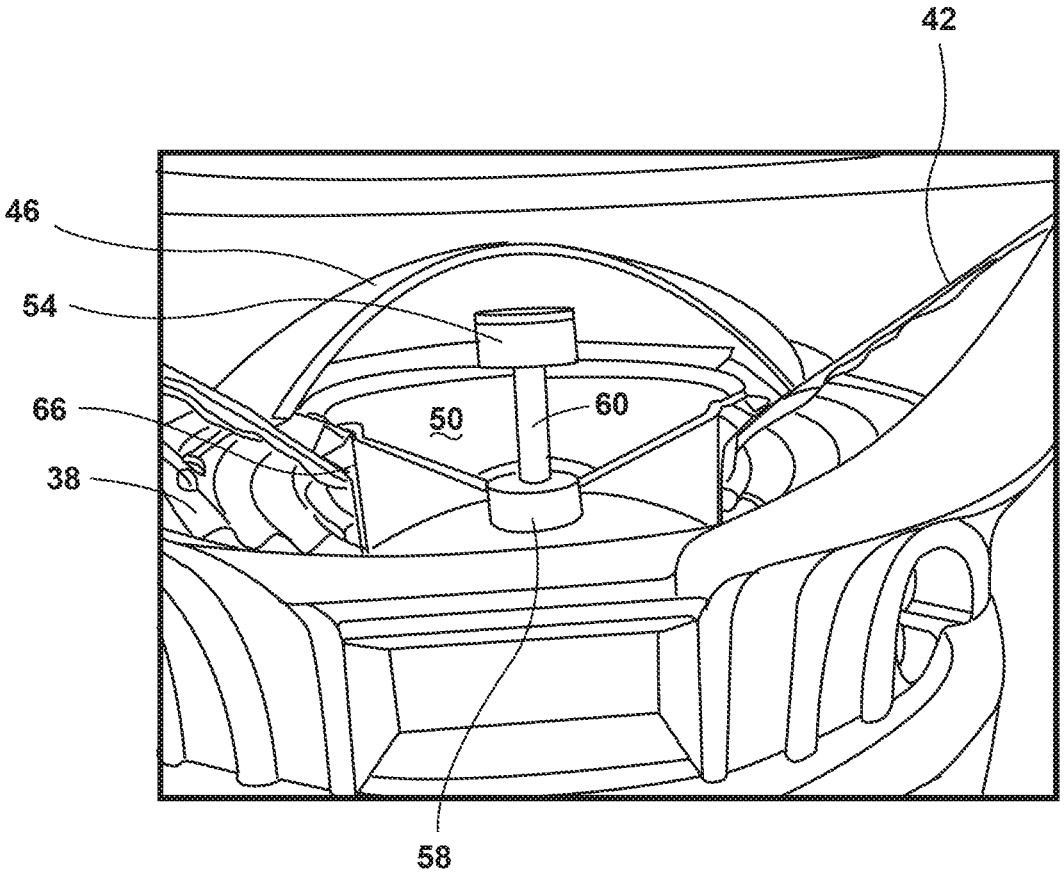
FIG. 11 illustrates a close up partial cut-away view of the loudspeaker of FIG. 6 at a minus ten mm displacement position for the contactor.

FIG. 9 is a close up view of the loudspeaker 30 shown in FIG. 6, including the contactor 50 and the front and rear contact receivers 54, 58 at a natural rest position (zero mm displacement). In the arrangement of FIG. 9, the front contact receiver 54 and the rear contact receiver 58 are spaced 10 millimeters (mm) from each side of the contactor 50. FIG. 10 shows a close up cut-away view of the contactor 50 disposed at about a −5 mm displacement with respect to the front and rear contact receivers 54, 58. FIG. 11 is a close up cut-away view of the contactor disposed at about a −10 mm displacement with respect to the front and rear contact receivers 54, 58.

Operation

In the orientation of the loudspeaker 30 shown in FIGS. 6-11, the contactor 50 moves upwardly or downwardly with the voice coil 66, the diaphragm 42, and the dust dome 46. The spider 38 and the surround 20 flex allowing the diaphragm 42 to move and generate sound waves. The support post 60 is rigid and maintains the front contact receiver 54 and the rear contact receiver 58 stationary relative to the voice coil 66 and the contactor 50, which move together, for example, from the rest position shown in FIG. 9 toward the position shown in FIG. 10 that is about five millimeters away from the rest position.

Until the 10 mm displacement is reached in either direction, only the stiffness of the spider 38 and the surround 20, flexing, have an effect upon the motion of the voice coil 66 and the contactor 50. Depending on the power and current applied to the voice coil 66, the contactor 50 impacts with, and thus deforms or compresses the front contact receiver 54 and/or the rear contact receiver 58 intermittently or occasionally depending on the operating parameters. FIG. 11 shows the contactor 50 in contact with the rear contact receiver 58. The deformation or compressive force of the front contact receiver 54 or the rear contact receiver 58 adds to the total stiffness function that is provided by the flexing of the spider 38 and the surround 20. Thus, the front contact receiver 54 is configured to resist and limit frontward movement of the contactor 50 and the voice coil 66. Likewise, the rear contact receiver 58 is configured to resist and limit rearward movement of the contactor 50 and the voice coil 66.

The multi-phase or multiple-stage suspension system for the loudspeaker 30 can have any desired shape curve. The loudspeaker 30 shown in FIG. 6 has a very linear suspension as shown by the primary stiffness curve A in FIG. 1. From 0 mm displacement to about +−10 mm of displacement, the loudspeaker 30 has an essentially constant stiffness. Then a secondary stiffness curve is provided by the contactor 50 physically contacting one of the contact receivers 54, 58 at about +−10 mm. of excursion (See FIGS. 9-11). This arrangement introduces a knee effect into the stiffness versus displacement curve at about 15 mm. The slope of the curve from a displacement of 10 mm and higher is the sum of the primary suspension system (surround 20, diaphragm 42, spider 38) and the contact receiver stiffness (impact of contactor 50 deforming one of the contact receivers 54, 58) results in a total stiffness function. The contact receivers 54, 58 are deformable foam or a deformable plastic in one embodiment. The deformable contact receivers 54, 58 result in the desired generally flat force curve C shown in FIG. 2 until a displacement of about +−15 mm is obtained whereat the contactor 50 modifies the total stiffness function of the multiple stage suspension system. In another embodiment, the contactor 50 is a deformable member and the contact receivers 54, 58 are a rigid member. The contactor 50 is capable of engaging at least one of the front contact receiver 54 and the rear contact receiver 58 to limit displacement of the contactor and the voice coil 66 and for modifying the total stiffness provided thereto.

Figure 1:
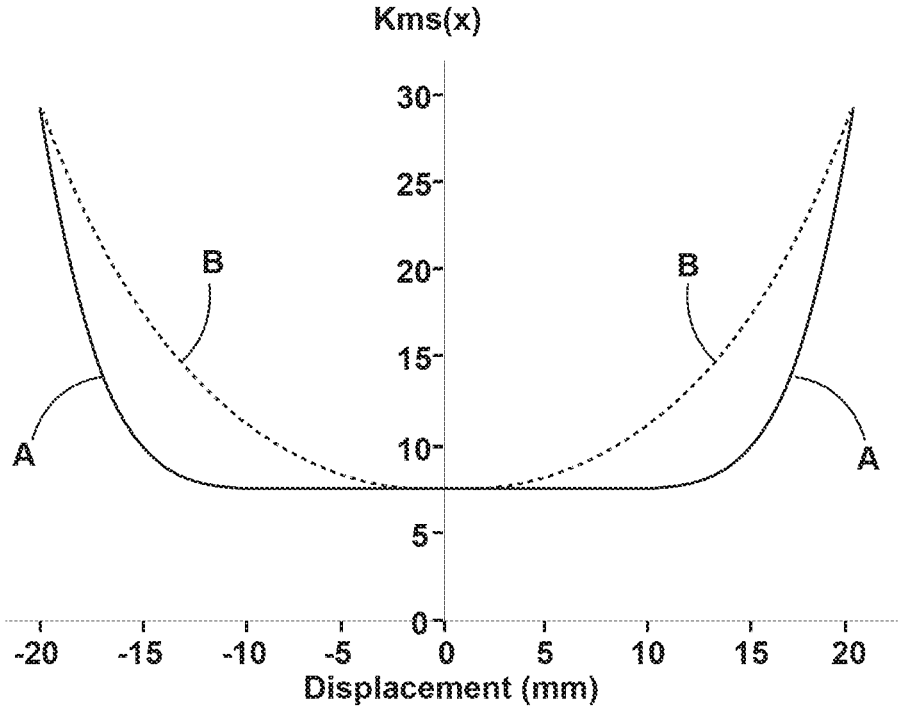
FIG. 1 is a graph with Curve A illustrating a total stiffness versus deflection curve.
Figure 2:
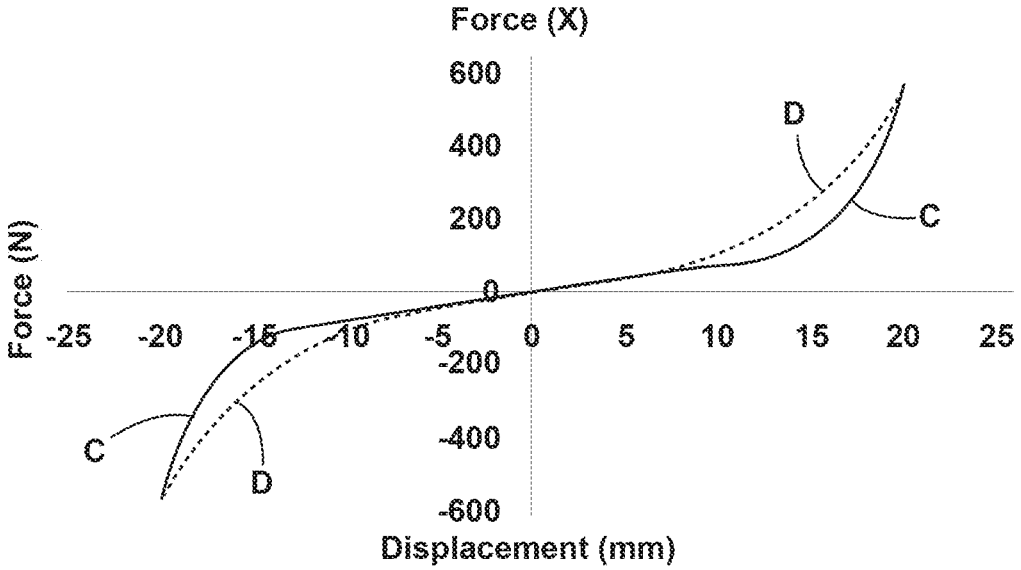
FIG. 2 is a graph with Curve C illustrating a force versus deflection curve.
Figure 3:
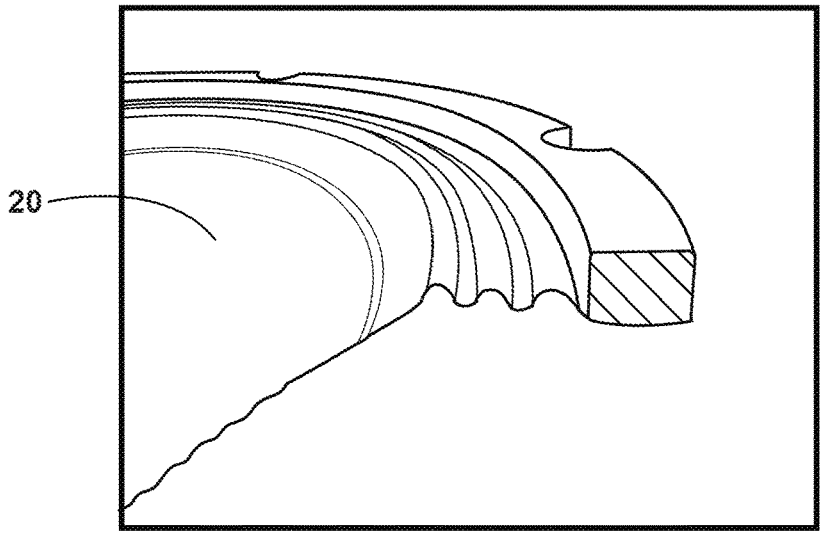
FIG. 3 illustrates a cut-away view of a surround of the loudspeaker at zero displacement.
Figure 4:
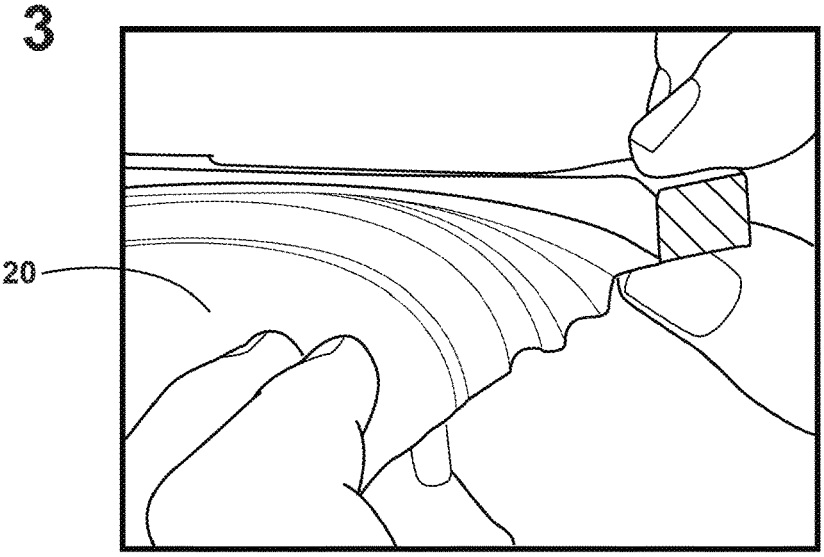
FIG. 4 illustrates a cut-away view of the surround at 50% of maximum displacement.
Figure 5:
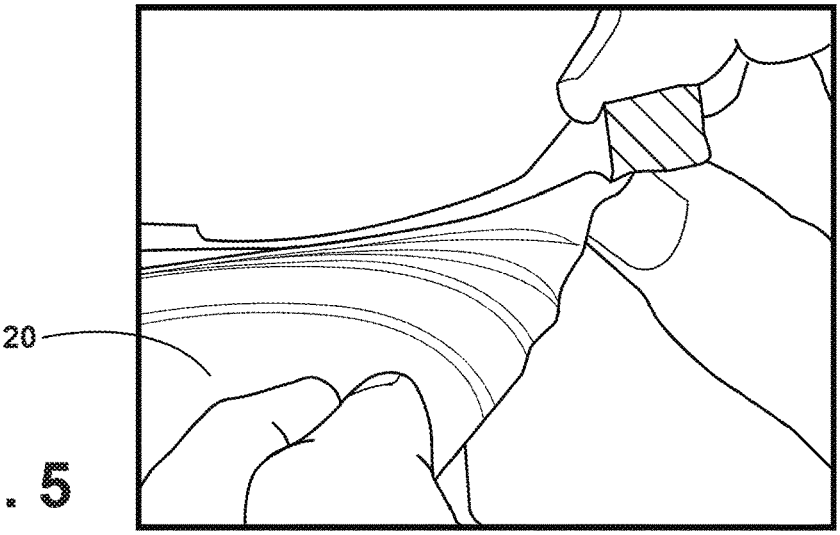
FIG. 5 illustrates a cut-away view of the surround at maximum displacement.

Controlling the total stiffness of the contact receivers 54, 58, along with the suspension system, determines the slope of the non-linear portion of the desired stiffness curve A shown in FIG. 1. Properly choosing the thickness and compressibility of the contact receivers 54, 58 results in asymptotic sections in the force curve C at the ends of the excursion that are desired as shown in FIG. 2. As the contactor 50 and a given contact receiver 54, 58 approach 100% compression, the stiffness approaches infinity. The advantages to this arrangement are that below about +−10 mm of excursion, there is an essentially linear stiffness curve and so there is very low distortion introduced by the movement of the voice coil 66 and the contactor 50. When the contactor 50 exceeds the +−10 mm of displacement, the loudspeaker is quietly and in a controlled fashion prevented from over excursion as a result of the total stiffness function for the multiple stage suspension system.

In operation, electronic transients caused by an inadvertent power cycle, a microphone connected to the loudspeaker 30 being dropped, a faulty wiring connection, etc. can cause a high level impulse to be sent to the voice coil 66. With the current arrangement, the impulse cannot drive the surround 20, the diaphragm 42, or other suspension components, so far as to cause damage to the loudspeaker 30. As can be seen from the nature of the construction shown in FIGS. 6-11, even in extreme instances, the loudspeaker 30 will hard limit displacement of the contactor 50 before allowing unwanted parts of the loudspeaker to collide or overextend. The multi-stage mechanical suspension system with the contactor arrangement will perform without causing damage. Even in the event of hard limiting, the suspension system will have only used approximately 60% of the available material length of the primary suspension components, such as the surround 20 and spider 38. The contactor arrangement decreases the potential for internal damage in the primary suspension system due to limiting movement and adjusting the change in stiffness over time.

Operation of the loudspeaker 30 is typically as a woofer having a frequency range of 20 hertz (Hz) to 2,000 Hz. In some embodiments, the loudspeaker operates as a subwoofer from 20 Hz to 200 Hz. In operation, the voice coil 66 generates low frequency sounds by moving the surround 20 and the spider 38. The front contact receiver 54, the support post 60, the rear contact receiver 58 and the center pole 70 are fixed and do not move in response to vibration of the voice coil 66. The contactor 50 is moveable rearwardly in FIG. 11 to contact a lower inner surface of the rear contact receiver 58 and frontwardly to contact an inner surface of the front contact receiver 54 during some percentage of the operation thereof. Displacement is inversely related to the square of the frequency content and linearly related to the peak drive voltage level. The number of times the contactor 50 actually makes contact with the front and rear contact receivers 54, 58 is completely dependent on the signal being output through the loudspeaker. The front and rear contact receivers 54, 58 also prevent damage to the components of the loudspeaker 30 in response to overdriving of the loudspeaker 30 due to various conditions.

Additional Embodiments

Figure 12:
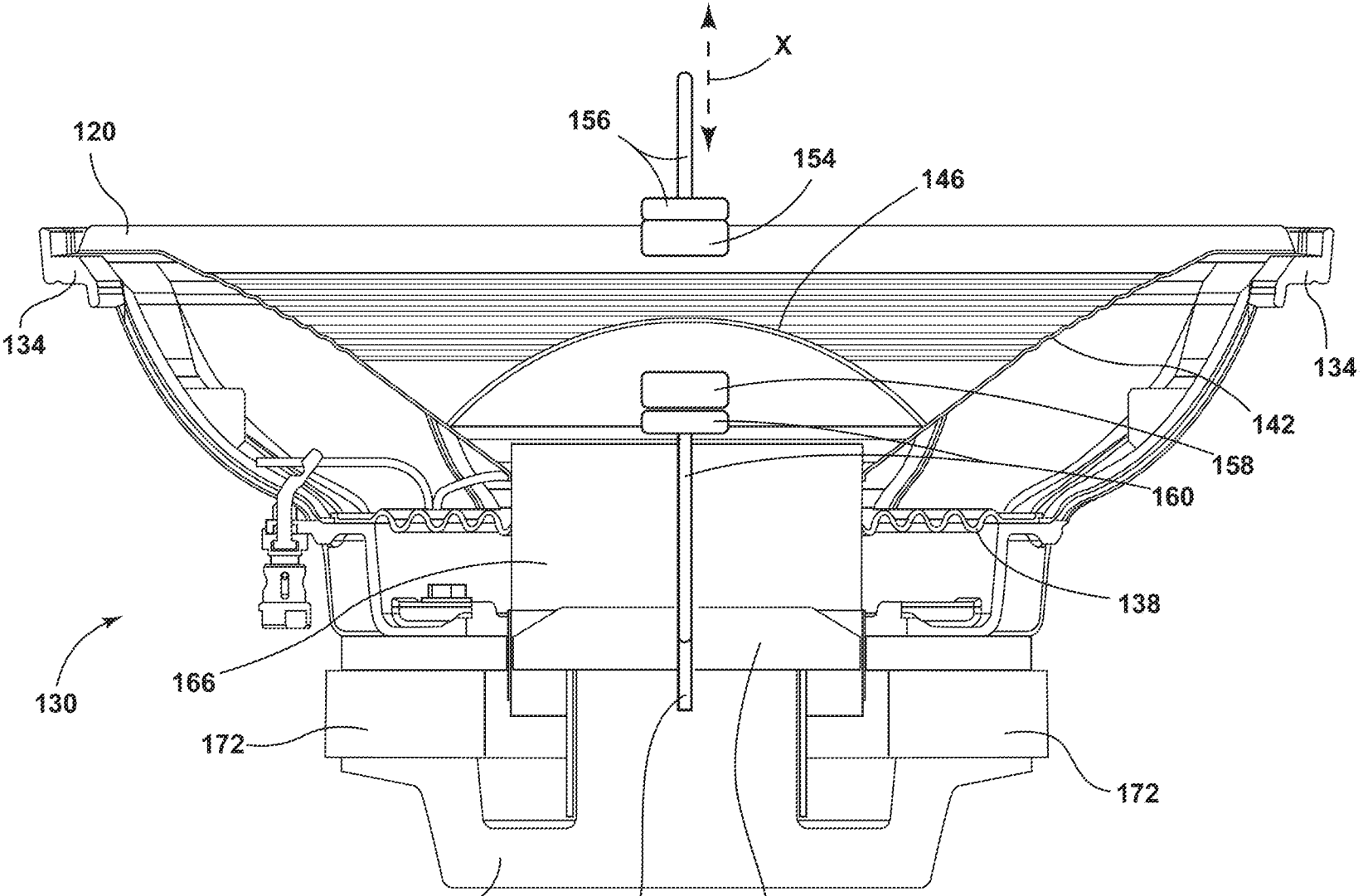
FIG. 12 illustrates a cross sectional view of another embodiment of the loudspeaker.

FIG. 12 shows another embodiment of the loudspeaker 130 having a frame 134. FIG. 12 shows a spider 138 and a diaphragm 142 that is secured about an outer periphery to an inner periphery of a surround 120. The surround 120 is secured to the frame 134. FIG. 12 also shows a dust dome 146 secured to a front surface of the diaphragm 142. Further, FIG. 12 shows a front contact receiver 154 that is secured to a front support post 156. The front support post 156 is secured to the frame 134 or to an external structure that supports the loudspeaker 130. A rear contact receiver 158 is supported by a rear support post 160.

FIG. 12 also shows a generally cylindrical shaped voice coil 166. An inner periphery of the spider 138 is secured to an outer surface of the voice coil 166 and an outer periphery of the spider is secured to an inner circumference of a front opening of the frame 134. Further, FIG. 12 shows an inner periphery of the diaphragm 142 secured to the voice coil 166 and an outer periphery of the diaphragm 142 secured to the surround 120. The spider 138, the surround 120, and the diaphragm 142 act as suspension components that define a suspension system for the voice coil 166 of the loudspeaker 130. The suspension components are joined by adhesives or other methods. The surround 120 via the diaphragm 142, along with the spider 138, provide a linear stiffness opposing movement of the voice coil 166 for a certain range of displacement along an axis X in FIG. 12.

The loudspeaker 130 shown in FIG. 12 includes a pole tip 168 that extends into interior of the voice coil 166. The rear support post 160 is secured to the pole tip 168. The pole tip 168 is secured to the center pole 170 in a stationary position. Thus, the support post 160 is rigid and holds or maintains the rear contact receiver 158 stationary relative to the voice coil 166.

In the embodiment of FIG. 12, the dust dome 146 is displaceable with the voice coil 166 via the diaphragm 142. In one embodiment, the diaphragm 142 is a generally rigid structure. Thus, the dust dome 146 is movable along an axis X defined by the length of the support post 160 to move forwardly or rearwardly, along with the voice coil 166 at a generally linear stiffness for a certain range of movement.

FIG. 12 shows a hollow toroid shaped magnet 172 provided on or within a back plate 176 adjacent the pole tip 168. FIG. 12 also shows an electrical contact 180 for receiving power from a power source (not shown) to drive the voice coil 166. The voice coil 166 includes a wound wire (not shown) for receiving current from a power source that generates an electromagnetic field for moving the voice coil 166 relative to the magnet 172 and other components, essentially back and forth along the X-axis to generate sound.

The embodiment illustrated in FIG. 12, functions in the same manner as the embodiment shown in FIGS. 6-11, except the dust dome 146 contacts the front contact receiver 154 and the rear contact receiver 158. Further, the support post 160 extends forwardly through substantially the entirety of the voice coil 166 to support the rear contact receiver 158 near the dust dome 146.

Figure 13:
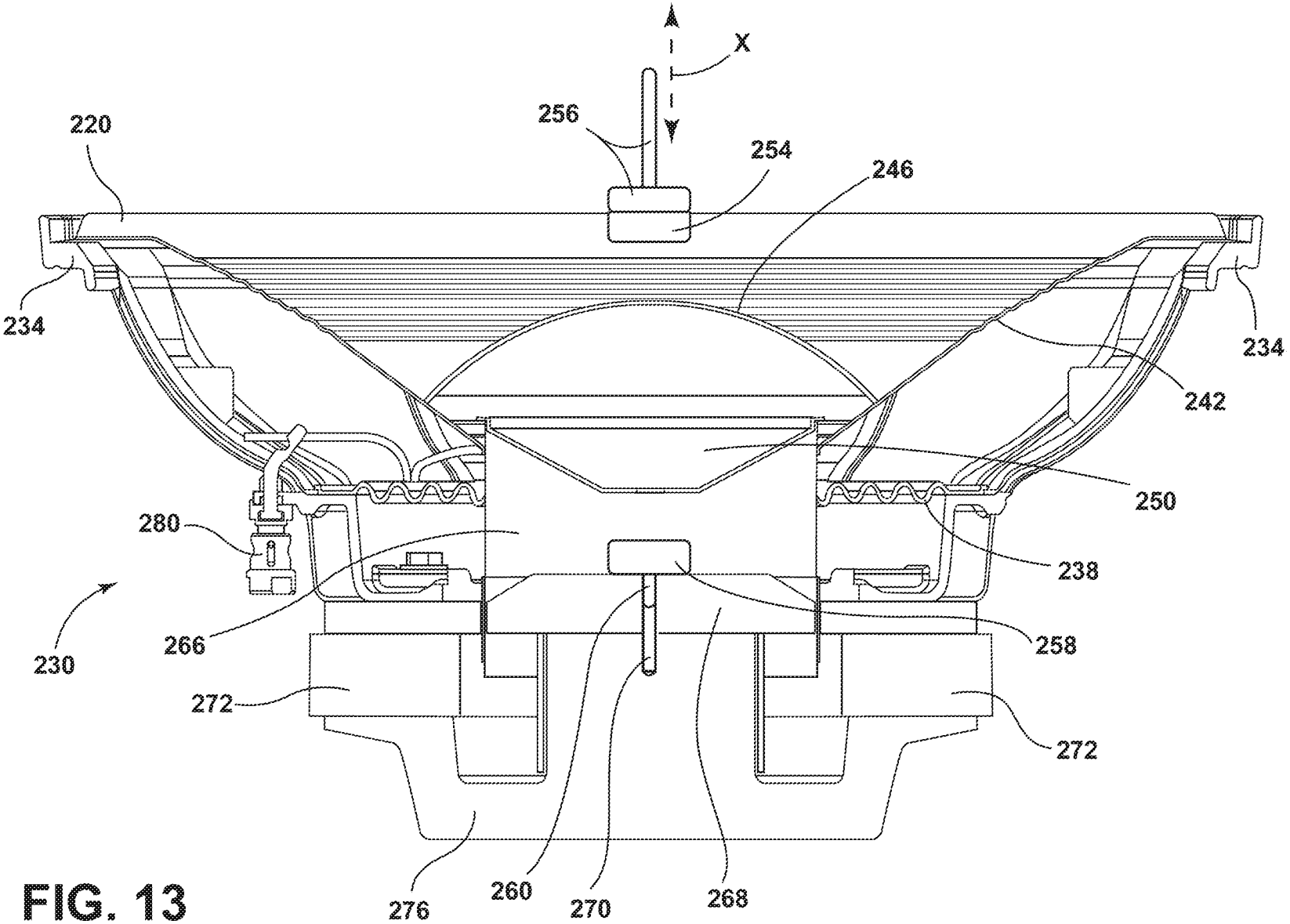
FIG. 13 illustrates a cross sectional view of yet another embodiment of the loudspeaker.

FIG. 13 shows another embodiment of the loudspeaker 230 having a frame 234. FIG. 13 shows a spider 238 and a diaphragm 242 that is secured about an outer periphery to an inner periphery of a surround 220. The surround 220 is secured to an inner periphery of the frame 234. FIG. 13 shows a dust dome 246 that is secured to a front surface of the diaphragm 242. The dust dome 246 acts as a separate dome-shaped front contactor in operation. FIG. 13 also shows a rear contactor 250. Further, FIG. 13 shows a front contact receiver 254 that is secured to a front support post 256. The front support post 256 is secured to the frame 234 or to an external structure that supports the loudspeaker 230. A rear contact receiver 258 is supported by a rear support post 260 or otherwise is secured directly to the surface of a pole tip 268.

FIG. 13 shows a generally cylindrical shaped voice coil 266 that supports the rear contactor 250. An inner periphery of the spider 238 is secured to an outer surface of the voice coil 266. An outer periphery of the spider 238 is secured to the frame 234. Further, FIG. 13 shows an inner periphery of the diaphragm 242 secured to the voice coil 266 and an outer periphery of the diaphragm 242 secured to an inner periphery of the surround 220. The spider 238, the surround 220, and the diaphragm 242 act as suspension components that define a suspension system for the voice coil 266 of the loudspeaker 230. The suspension components are joined by adhesives or other methods. The surround 220 via the diaphragm 242, along with the spider 238, provide a linear stiffness opposing movement of the voice coil 266 for a certain range of displacement.

The pole tip 268 of the loudspeaker 230 shown in FIG. 13 extends into the voice coil 266. In one embodiment, the rear support post 260 is secured to the pole tip 268. The pole tip is secured to a center pole 270. Thus, the support post 260 is rigid and holds or maintains the rear contact receiver 258 stationary relative to the voice coil 266. In another embodiment, the rear contact receiver 258 is secured directly to a surface of the pole tip 268.

In the embodiment of FIG. 13, the dust dome 246 is displaceable with the voice coil 266 via the diaphragm 242. Thus, the dust dome 246 is movable along a single axis X defined by the length of the support post 260 to move forwardly or rearwardly, along with the voice coil 266 at a generally linear stiffness for a certain range of movement.

FIG. 13 shows a toroid shaped magnet 272 provided on or within a back plate 276 adjacent the pole tip 268. FIG. 13 also shows an electrical contact 280 for receiving power from a power source (not shown) to drive the voice coil 266. The voice coil 266 includes a wound wire (not shown) for receiving current from a power source that generates an electromagnetic field for moving the voice coil 266 relative to the magnet 272 and other components, essentially back and forth along the single X-axis to generate sound.

The embodiment illustrated in FIG. 13, functions in the same manner as the embodiment shown in FIGS. 6-11, except the dust dome 246 acts as a dome-shaped front contactor that contacts the front contact receiver 254. Further, the rear contactor 250 only contacts the rear contact receiver 258. The dust dome 246 and the rear contactor 250 act to control the stiffness versus the displacement of the voice coil 266.

A method of operating the multiple-stage loudspeaker 30, 130, 230 of the various embodiments having a voice coil 66, 166, 266, suspended by a suspension system, at least one contactor 50, 150, 250 movable by the voice coil, and a contact receiver that is not continuously engaged physically with the contactor or the voice coil, includes the following steps. Applying a first electrical input to the voice coil 66, 166, 266 to vibrate the voice coil and produce sound, wherein when the movable contactor 50, 150, 250 does not engage the contact receiver, the loudspeaker provides an essentially linear stiffness for a portion of a total displacement of the voice coil. The method includes applying a second electrical input to the voice coil to vibrate the voice coil and produce sound, wherein when the movable contactor engages the contact receiver the loudspeaker provides an essentially non-linear stiffness for the increased displacement of the voice coil. In one embodiment, the contact receiver is a front contact receiver and the loudspeaker further includes a rear contact receiver. The portion of the total displacement of the voice coil that provides the essentially linear stiffness is about −15 millimeters or about +15 millimeters from a rest position, wherein non-linear stiffness occurs in response to additional displacement of the voice coil. In one embodiment, the method includes applying a third electrical input to the voice coil greater than the first or second electrical input to produce sound, wherein the movable contactor engages the contactor receiver, and the contact receiver is a foam material wherein the essentially non-linear stiffness of the foam material is compressed to result in essentially a stop, wherein a substantially full limiting of movement of the voice coil occurs.

In one embodiment, the contactor 50, 150, 250 is movable along the axis X a distance <90% of s maximum expected displacement distance before contacting either the front contact receiver 54, 154, 254 or the rear contact receiver 58, 158, 258.

There can be more than two stages in the suspension system. Multiple additional elements may join into the stiffness curve at different displacements. Another advantage to this limiting is the reduction of stresses in both the flexible connections and also the surround 20 and other parts of the loudspeaker 30.

In one embodiment, the diaphragm 42, 142, 242 includes adhesive joints for securement to the surround 20, 120, 220. The diaphragm, the surround, and another adhesive joint between the diaphragm and the voice coil are all stressed by forces opposing each other through the materials. In one embodiment, all the limiting forces are moved to be applied as close to the voice coil 66, 166, 266 as possible. In another embodiment, the limiting forces are transferred all the way to the voice coil 66, 166, 266. This means that at high excursions, the force applied by the surround 20, 120, 220 to the diaphragm 42, 142, 242 is minimal and the high magnitude limiting forces are applied directly to the top of the voice coil 66, 166, 266. This arrangement leads to better long term stability and robustness of design.

In one embodiment, the contactor 50 is a fender. In one embodiment, the front contact receiver 54, 154, 254 is a front bumper and the rear contact receiver 58, 158, 258 is a rear bumper. In another embodiment the front contact receiver 54, 154, 254 is a cantilevered or bendable support and the rear contact receiver 58, 158, 258 is a cantilevered or bendable support that bends or flexes in response to force applied thereto by the contactor 50.

In one embodiment, the center pole 70 and the back plate 76 are provided as a single piece monolithic element, such as a T-yoke.

Thus, the invention provides, among other things, a loudspeaker for low frequency output having a suspension system and a voice coil with at least one contactor movable by the voice coil, a front contact receiver and a rear contact receiver that are not continuously engaged with the contactor, but limit movement thereof, and a suspension system that enables movement of the voice coil to generate sound. Various features and advantages of the invention are set forth in the following claims.

What is claimed is:

1. A loudspeaker (30,130, 230) having a frame (34, 134, 234) and comprising:

a suspension system secured to the frame;

a voice coil (66, 166, 266) disposed within the frame and suspended by at least the suspension system;

at least one contactor (50, 150, 250) movable by the voice coil;

a front contact receiver (54, 154, 254) that is not continuously engaged with the contactor or the voice coil, the front contact receiver being configured to limit frontward movement of the contactor and the voice coil, and a rear contact receiver that is not continuously engaged with the contactor or the voice coil, the rear contact receiver being configured to limit rearward movement of the contactor and the voice coil, wherein the contactor is capable of engaging at least one of the front contact receiver and the rear contact receiver to limit displacement of the contactor and the voice coil.

2. The loudspeaker according to claim 1, wherein the voice coil and the contactor are displaceable along a single axis a distance of about <90% of a maximum expected displacement distance before contacting either the front contact receiver or the rear contact receiver, the contact modifying total stiffness function of the loudspeaker.

3. The loudspeaker according to claim 1, the suspension system including a diaphragm (42, 142, 242) having an inner periphery secured to the voice coil and an outer periphery secured to an inner periphery of a surround (20, 120, 220) that is secured about an outer periphery to the frame.

4. The loudspeaker according to claim 1, the suspension system including a flexible rear spider (38, 138,238) having an inner periphery secured to the voice coil and an outer periphery secured to the frame for suspending the voice coil.

5. The loudspeaker according to claim 1, wherein the contactor is a fender secured to the voice coil for intermittently contacting with the front contact receiver and the rear contact receiver.

6. The loudspeaker according to claim 5, wherein the front contact receiver and the rear contact receiver are a front bumper and a rear bumper joined in spaced relationship by a support post, the loudspeaker including:

a center pole disposed adjacent the rear bumper receiving the support post, wherein the fender is disposed between the rear bumper and the front bumper in a rest position, the fender having an aperture that receives the support post, and wherein the fender moves axially along a length of the support post in response to movement of the voice coil.

7. The loudspeaker according to claim 6, wherein the front bumper and the rear bumper are secured to opposing ends of the support post and the center pole, and the loudspeaker is a woofer.

8. The loudspeaker according to claim 6, wherein the fender is movable along the axis of the support post a distance of about <90% of a maximum expected displacement distance of the suspension system before contacting either the front bumper or the rear bumper, contact with either of the front bumper and the rear bumper modifying total stiffness function of the loudspeaker.

9. The loudspeaker according to claim 1, wherein the contactor is a dome disposed adjacent to and frontwardly of the voice coil.

10. The loudspeaker according to claim 9, wherein the front contact receiver is secured to the frame of the loudspeaker or to an external structure and disposed for contacting the dome.

11. The loudspeaker according to claim 10, wherein the rear contact receiver is supported by a support post secured to a pole tip, the support post extending forwardly through substantially the entirety of the voice coil to support the rear contact receiver therein.

12. The loudspeaker according to claim 11, wherein the suspension system includes a diaphragm having an inner periphery secured to the voice coil and an outer periphery secured to an inner periphery of a surround that is secured about an outer periphery to the frame, and the dome is secured to the diaphragm, and wherein the dome is configured to intermittently contact the front contact receiver and/or the rear contact receiver when the dome moves axially toward and away from the contact receivers in response to movement of the voice coil.

13. A loudspeaker (30,130, 230) having a frame (34, 134, 234) and comprising:

a suspension system secured to the frame;

a voice coil (66, 166, 266) disposed within the frame and suspended by at least the suspension system;

at least one contactor (50, 150, 250) movable by the voice coil;

a front contact receiver (54, 154, 254) that is not continuously engaged with the contactor of the voice coil, the front contact receiver being configured to limit frontward movement of the contactor and the voice coil, and a rear contact receiver that is not continuously engaged with the contactor of the voice coil, the rear contact receiver being configured to limit rearward movement of the contactor and the voice coil, wherein the contactor is capable of engaging at least one of the front contact receiver and the rear contact receiver to limit displacement of the contactor and the voice coil, and wherein the contactor is a rear contactor secured to the voice coil, and the loudspeaker includes a separate dome-shaped front contactor.

14. The loudspeaker according to claim 13, wherein the front contact receiver is secured to the frame of the loudspeaker or to an external structure.

15. The loudspeaker according to claim 14, wherein the rear contact receiver is supported by a support post secured to a pole tip, wherein the rear contactor moves axially toward and away from the rear contact receiver in response to movement of the voice coil.

16. The loudspeaker according to claim 15, wherein the voice coil is movable along an axis a distance of about <90% of a maximum expected displacement distance before either the separate dome-shaped front contactor contacts the front contact receiver or the rear contactor contacts the rear contact receiver, the contact modifying total stiffness function of the loudspeaker.

17. A method of operating a multiple-stage loudspeaker comprising:

a voice coil suspended by a suspension system, at least one contactor movable by the voice coil, and a contact receiver that is not continuously physically engaged with the contactor or the voice coil, the method comprising:

applying a first electrical input to the voice coil to vibrate the voice coil and produce sound, wherein when the contactor moves and does not engage the contact receiver, the loudspeaker provides an essentially linear stiffness for a portion of a total displacement of the voice coil, and applying a second electrical input to the voice coil to vibrate the voice coil and produce sound, wherein when the movable contactor engages the contact receiver, the loudspeaker provides an essentially non-linear stiffness for an increased displacement of the voice coil.

18. The method according to claim 17, wherein the contact receiver is a front contact receiver and the loudspeaker further includes a rear contact receiver.

19. The method according to claim 18, wherein the portion of the total displacement of the voice coil that provides the essentially linear stiffness is about −15 millimeters or about +15 millimeters from a rest position, wherein essentially non-linear stiffness occurs in response to additional displacement of the voice coil.

20. The method according to claim 17, including applying a third electrical input to the voice coil greater than the first or second electrical input to produce sound, wherein the contactor moves and engages the contact receiver, and the contact receiver is a foam material wherein the essentially non-linear stiffness of the foam material is compressed to result in essentially a stop, wherein a substantially full limiting of movement of the voice coil occurs.

* * * * *